US008119959B1

(12) United States Patent
Ransom

(10) Patent No.: US 8,119,959 B1
(45) Date of Patent: Feb. 21, 2012

(54) FLIGHT CONTROL OF MISSILES

(75) Inventor: Richard Sutton Ransom, Killinchy (IE)

(73) Assignee: Short Brothers PLC, Belfast (IE)

( * ) Notice: Subject to any disclaimer, the term of this patent is extended or adjusted under 35 U.S.C. 154(b) by 0 days.

(21) Appl. No.: 07/018,566

(22) Filed: Feb. 27, 1987

(30) Foreign Application Priority Data

Feb. 27, 1986 (GB) ..... 8604912

(51) Int. Cl.
*F42B 15/01* (2006.01)
*F42B 15/00* (2006.01)

(52) U.S. Cl. ..... 244/3.22; 244/3.1; 244/3.15; 244/3.21; 239/265.19; 239/265.25; 239/265.27; 239/265.29; 239/265.31

(58) Field of Classification Search ..... 244/3.22; 239/265.19, 265.25, 265.27, 265.29, 265.31
See application file for complete search history.

(56) References Cited

U.S. PATENT DOCUMENTS 4,463,921 A * 8/1984 Metz ..... 244/3.22
4,482,107 A * 11/1984 Metz ..... 244/3.22
4,589,594 A * 5/1986 Kranz ..... 244/3.22
4,681,283 A * 7/1987 Kranz ..... 244/3.22
4,685,639 A * 8/1987 Bains ..... 244/3.22

* cited by examiner

*Primary Examiner* — Bernarr Gregory
(74) *Attorney, Agent, or Firm* — Venable LLP; Jeffri A. Kaminski; Todd R. Farnsworth

(57) ABSTRACT

A missile in which a nose portion is rotatably mounted on a main body portion of the missile and is subjected to thrust to bring it to a demanded roll attitude and to apply to it a demanded lateral steering force. The thrust is produced by a propellant gas and supplied to discharge ducts in the nose portion which provide for the discharge of the propellant gas tangentially with respect to the nose portion. The discharge ducts are selectively opened and closed by relative axial displacement of the nose portion and a valve spool which controls the flow of propellant gas. An actuator responsive to guidance control signals causes a predetermined roll torque to bring the nose portion to a demanded roll attitude and a predetermined lateral steering force on the missile.

7 Claims, 4 Drawing Sheets

FLIGHT CONTROL OF MISSILES

BACKGROUND

The present invention relates to the control of missiles in flight.

It is generally accepted that aerodynamic control surfaces, both fixed and moveable, are the most effective means for controlling missile flight within the earth's atmosphere and most missiles make use of them. Although they produce additional drag, their effectiveness in terms of missile weight, turning moment and actuating power consumption is difficult to surpass with any other form of control.

In a surface-to-air missile hitherto proposed, aerodynamic control surfaces have been provided on a rotatable nose portion to bring the nose portion to a required roll attitude and to apply a lateral thrust on the nose portion to steer the missile on to a corrected flight path. This form of control is usually referred to as a "twist and steer" control. Such flight control has also been used in a modified form where the nose portion continues to rotate and the lateral thrust produced by the aerodynamic control surfaces on it made effective at the required roll attitude by braking the nose portion momentarily when in the required roll attitude. The main body portion of the missile has also been provided with control surfaces which cause the body to rotate during flight to provide directional stability. Both forms of "twist and steer" control have been found to be successful for missile guidance in the earth's atmosphere and can be provided at low cost.

In a surface-to-air missile hitherto proposed the aerodynamic control surfaces have comprised a pair of aileron control surfaces and pair of elevator control surfaces which have been effective at low altitude for rotating the nose portion at the required rotational speed and for applying the required lateral steering force on the missile. The reaction forces available at high altitude may however not be found to be sufficient to generate a high enough roll torque to spin the nose portion at a satisfactorily high rotational speed. Furthermore the elevator surfaces which should of course not be so large as to impede launch of the missile may be found to be not large enough to generate sufficient lateral steering force at high altitudes.

SUMMARY

An object of the present invention is to provide a missile which does not suffer from the aforementioned disadvantages and which is capable of controlled flight at high altitudes.

According to the present invention there is provided a missile comprising flight control means including a control portion rotatably mounted on a main body portion of the missile for rotation about the longitudinal axis of the missile and thrust producing means for controlling rotation of the control portion to bring it to a demanded roll attitude and to apply a demanded lateral steering force on the control portion in the demanded roll attitude, characterised by the fact that the thrust producing means includes a propellant carried by the missile for generating thrust producing propellant gas, a plurality of discharge ducts which have discharge openings in the surface of the control portion to provide for the discharge therefrom of propellant gas tangentially or partially tangentially with respect to the control portion and which are arranged to be supplied with propellant gas through supply ports arranged in predetermined spaced relation along the length of the control portion, valve means responsive to relative axial displacement of the control portion and the valve means selectively to control the flow of propellant gas to the supply ports and actuator means responsive to guidance control signals to cause relative axial displacement of the control portion and the valve means between a first relative disposition in which propellant gas is supplied to the discharge ducts and discharged from the discharge openings in such distribution and amount that it applies to the control portion a predetermined roll torque to bring the control portion to or assist it in being brought to a demanded roll attitude and a second relative disposition in which the propellant gas is supplied to the discharge ducts and discharged from the discharge openings in such distribution and amount that it applies to the control portion in the demanded roll attitude a predetermined lateral steering force on the missile.

Preferably, the control portion is mounted for axial displacement relative to the main body portion of the missile, and the actuator means is operative to cause axial displacement of the control portion to bring the valve means and the control portion to their first and second dispositions.

In an embodiment of the invention hereinafter to be described the valve means comprises a valve spool including supply ducts for the supply of propellant gas to the supply ports. The valve spool extends forwardly from the main body portion in fixed relation thereto and the control portion is formed by a nose portion of the missile, which is mounted on the valve spool with a skirt portion extending over the valve spool and with the discharge ducts formed in the skirt portion.

In the embodiment of the invention hereinafter to be described, the discharge ducts comprise first and second ducts arranged on opposite sides of the control portion for the discharge of propellant gas tangentially in opposite directions and a third discharge duct arranged on the same side of the control portion as the second discharge duct for discharge of propellant gas tangentially in the same direction as the first discharge duct. Propellant gas is supplied to the first and second discharge ducts and discharged from the discharge openings in the first relative disposition of the control portion and the valve means to produce the predetermined roll torque and propellant gas is supplied to at least the first and third discharge ducts in the second relative disposition of the control portion and the valve means to produce the predetermined lateral steering force on the missile.

In the embodiment of the invention hereinafter to be described, the first and second ducts are of equal predetermined discharge capacities, the third discharge duct is of a discharge capacity twice that of the predetermined discharge capacity and the, arrangement is such that when the control portion and the valve means move to the first relative disposition propellant gas is discharged at full discharge capacity from the first and second discharge ducts to produce the predetermined roll torque, with no propellant gas being discharged from the third discharge duct and when the control portion and the valve means move to the second relative disposition propellant gas is discharged at half the predetermined discharge capacity from the second discharge duct, at full discharge capacity from the first discharge duct and at three quarters discharge capacity from the third discharge duct thereby to produce a transverse thrust on the control portion without roll torque.

In the embodiment of the invention hereinafter to be described, the actuator means is responsive to guidance control signals to cause relative axial displacement of the control portion and the valve means to a third relative disposition and the arrangement is such that in the third relative disposition no propellant gas is discharged from the second discharge duct, propellant gas is discharged at full capacity from the first discharge duct and from the third discharge duct in an amount equal to twice that of the first discharge duct thereby to produce a braking roll torque on the control portion opposite to the roll torque produced by the first and second discharge ducts in the first relative disposition of the control portion and the valve means, together with a lateral steering force on the missile.

BRIEF DESCRIPTION OF THE DRAWINGS

An embodiment of the invention will now be described by way of example, with reference to the accompanying drawings, in which.

DETAILED DESCRIPTION

Figure 1:
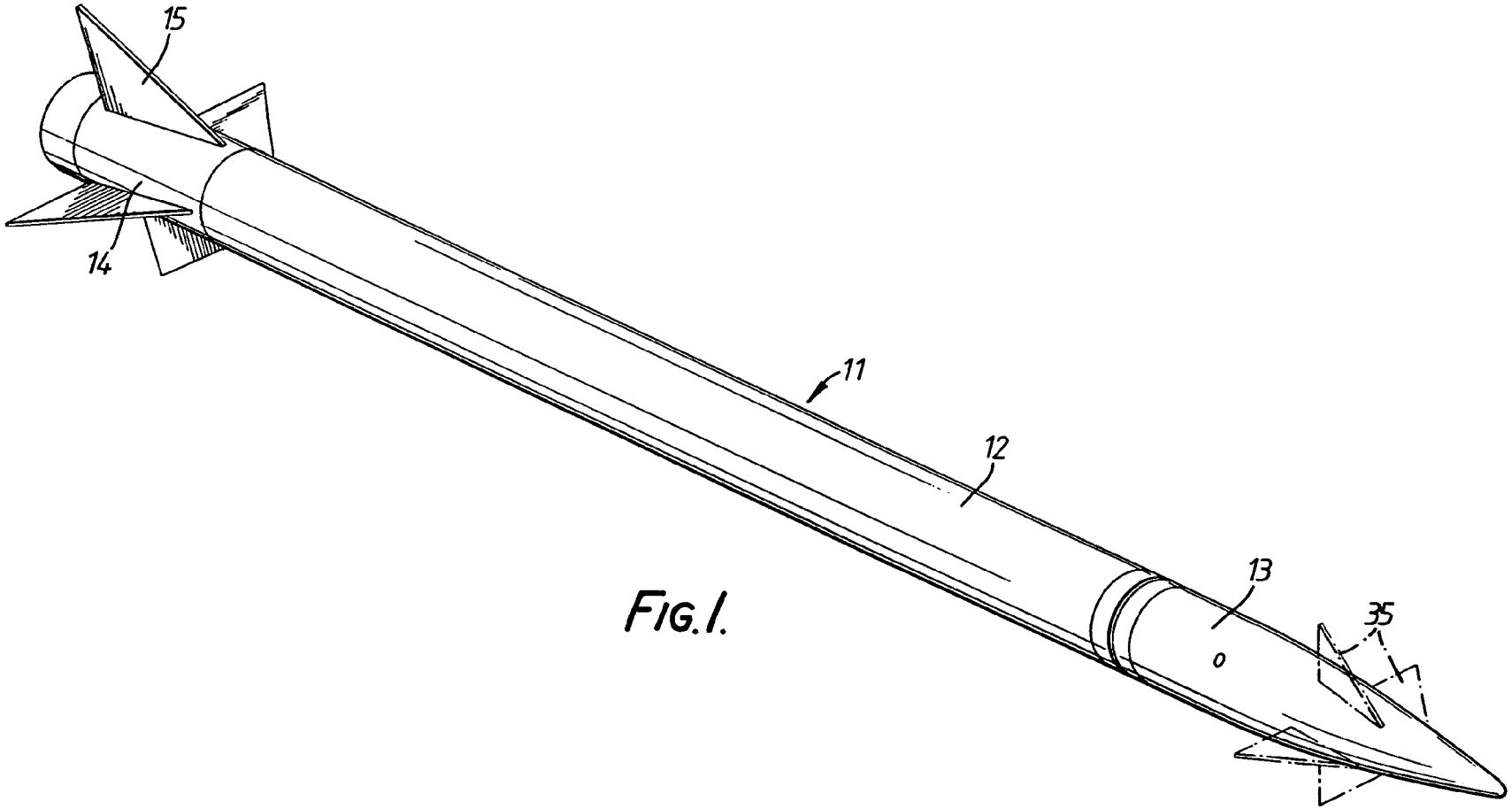
FIG. 1 is a schematic perspective view of a missile according to the invention.

Referring first to FIG. 1, a missile 11 comprises a main body portion 12, a nose portion 13 and a tail section 14 carrying stabilising fins 15 providing stabilising rotation of the main body portion 12 of the missile.

Figure 2:
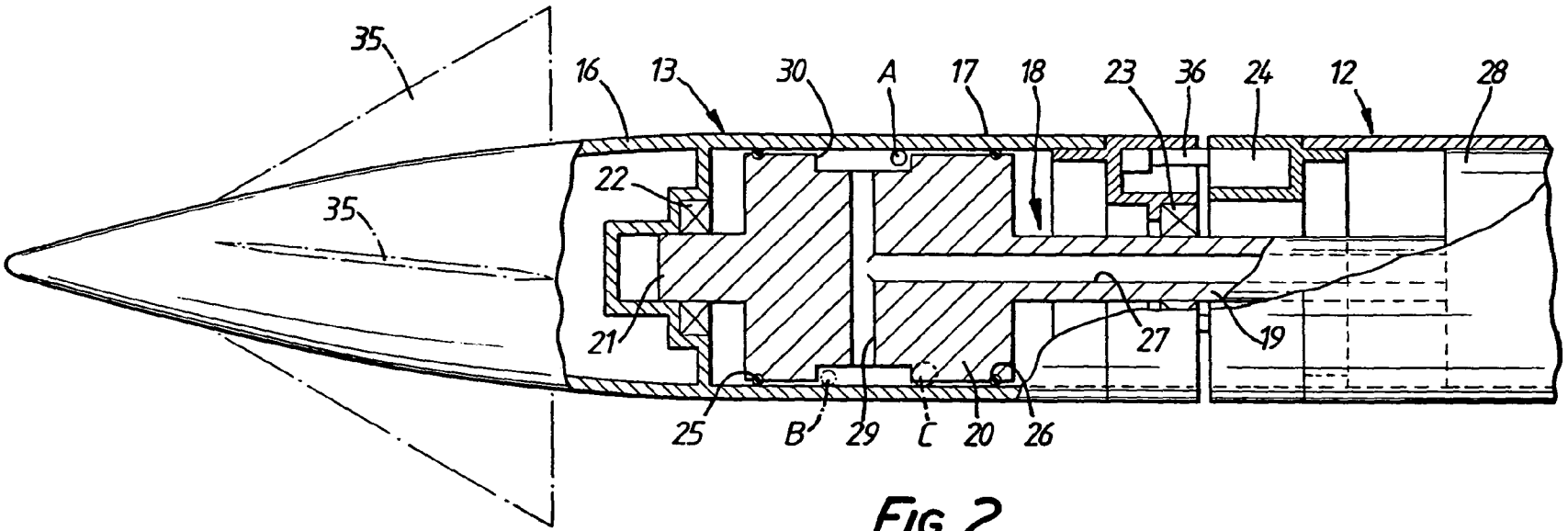
FIG. 2 is a part cross-sectional side elevation of a forward portion of the missile shown in FIG. 1.

As best seen in FIG. 2, the nose portion 13 comprises a front section 16 and a rearwardly extending skirt 17. The main body portion 12 of the missile carries a forwardly extending nose support structure 18 upon which the nose portion 13 of the missile is rotatably mounted. The support structure 18 comprises a stem portion 19, an enlarged cylindrical spool portion 20 and a support spigot 21 and the nose portion 13 is rotatably supported at its forward end on the spigot 21 by bearings 22 and at its rear end on the stem portion 19 by bearings 23. In addition, the nose portion 13 is axially slidable on the structure 18 under the control of an actuator 24.

The spool portion 20 fits within the skirt 17 of the nose portion 13 with a small clearance which is sealed fore and aft by 0-ring seals 25 and 26. The stem portion 19 of the support structure 18 is provided with an axial passage 27 for the supply of propellant gas from a rocket propellant 28. The axial passage 27 terminates in a diametral passage 29 which opens into an annular recess 30 formed in the cylindrical surface of the spool portion 20.

Figure 3:
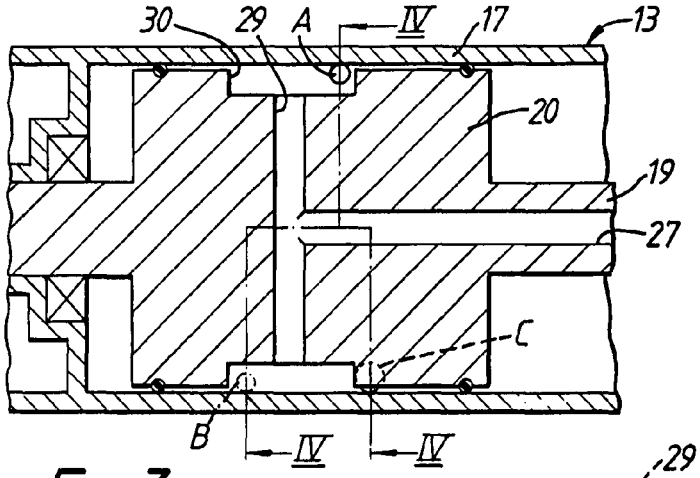
FIG. 3 is a cross-sectional side elevation of a part of a nose portion of the missile shown in FIG. 2 in an initial disposition of the nose portion in which discharge ducts therein are arranged to discharge propellant gas to produce a predetermined rotation of the nose portion.
Figure 4:
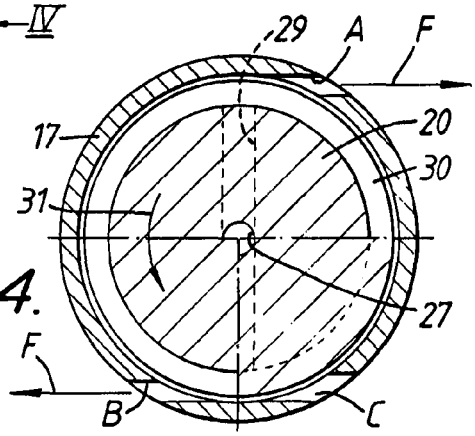
FIG. 4 is a schematic off-set cross-section of the nose portion shown in FIG. 3 taken on the lines IV-IV in FIG. 3 and serving to illustrate the circumferential dispositions of the discharge ducts shown in FIG. 3, the section being off-set appropriately to illustrate all three axially spaced discharge ducts.

Referring now to FIGS. 3 and 4, the skirt 17 of the nose portion 13 is provided with first and second discharge ducts A and B arranged in diametrically opposite dispositions and a third discharge duct C arranged on the same side of the skirt 17 as the first discharge duct A. As best seen in FIG. 4, the discharge ducts A, B and C have discharge openings in the surface of the skirt 17 and are arranged to provide for the discharge therefrom of propellant gas tangentially with respect to the nose portion 13 of the missile. The first and second ducts A and B provide for the discharge of propellant gas tangentially in opposite directions and the third discharge duct C is arranged for the discharge of propellant gas in the same direction as the first discharge duct A.

It will however be seen from FIG. 3 that the discharge ducts A, B and C are arranged in spaced relation along the length of the skirt 17, forming at their inner ends supply ports which are selectively opened and closed by axial movement of the nose portion 13 of the missile relative to the spool portion 20.

In operation, the missile 11 is fired and a stabilising rotation of the main body portion 12 of the missile initiated by the stabilising rear fins 15. At firing, or at a predetermined time following firing, the rocket propellant 28 is ignited and propellant gas is applied along the passageways 27 and 29 to the annular recess 30 in the spool portion 20. At firing, the actuater 24 is not energised and the nose portion 13 of the missile is held in the axial disposition shown in FIGS. 2, 3 and 4, in which the two discharge ducts A and B lie within the annular recess 30 and are exposed to propellant gas at full pressure, while the discharge duct C is cut off from the gas by the spool portion 20. The ducts A and B are of equal discharge capacities and the discharge of propellant gas from them at full capacity produces equal and opposite efflux forces F which impart to the nose portion 13 of the missile as indicated by the arrow 31, a roll torque causing it to rotate at a predetermined speed.

While the missile is on course to a target the actuator 24 remains unenergised and the nose portion 13 continues to rotate without providing any lateral steering force for flight path correction.

Figure 5:
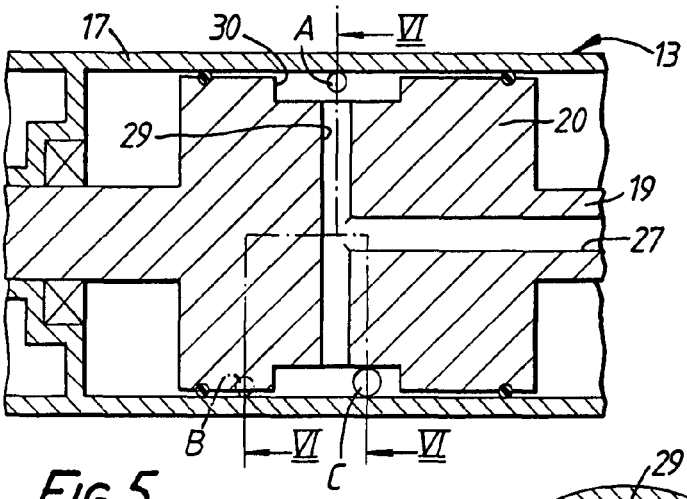
FIG. 5 is a schematic cross-sectional side elevation corresponding to that shown in FIG. 3, but illustrating a disposition of the nose portion in which the discharge ducts are arranged to discharge propellant gas to produce a braking roll torque and a lateral steering force on the nose portion.
Figure 6:
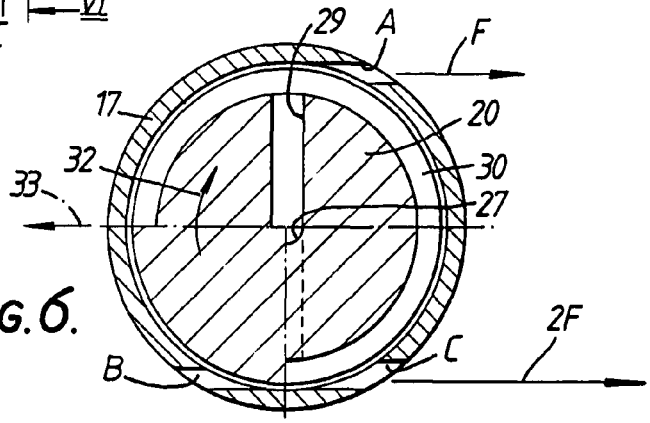
FIG. 6 is a schematic off-set cross-section corresponding to that shown in FIG. 4 and taken on the line VI-VI in FIG. 5 to illustrate the thrusts produced by propellant gas discharged from the discharge ducts in the disposition shown in FIG. 5.

In response to a deviation of the missile from the required flight path, the actuator 24 responds to guidance control signals fed to it and upon full energisation drives the nose portion 13 of the missile forwardly on the support structure 18 so that the discharge ducts take up relative dispositions shown in FIGS. 5 and 6. As will be seen from FIG. 5, the discharge duct A remains open to receive propellant gas at full capacity to produce an efflux force F while the discharge duct B is cut off by the spool portion 20. At the same time, the discharge duct C takes up an open disposition and receives propellant gas at full capacity. The discharge duct C is arranged to have a discharge capacity equal to twice that of discharge duct A or B, thereby producing an efflux force 2F, with the result that the propellant gases discharged from ducts A and C together produce a braking roll torque on the nose portion 13 in the direction indicated by the arrow 32 which is in an opposite direction to that of the roll torque 31 produced by discharge at full capacity from the discharge ducts A and B in the initial disposition of the nose portion 13. In addition, the propellant gases discharged from ducts A and C together produce a lateral thrust 33 on the nose portion 13.

Figure 7:
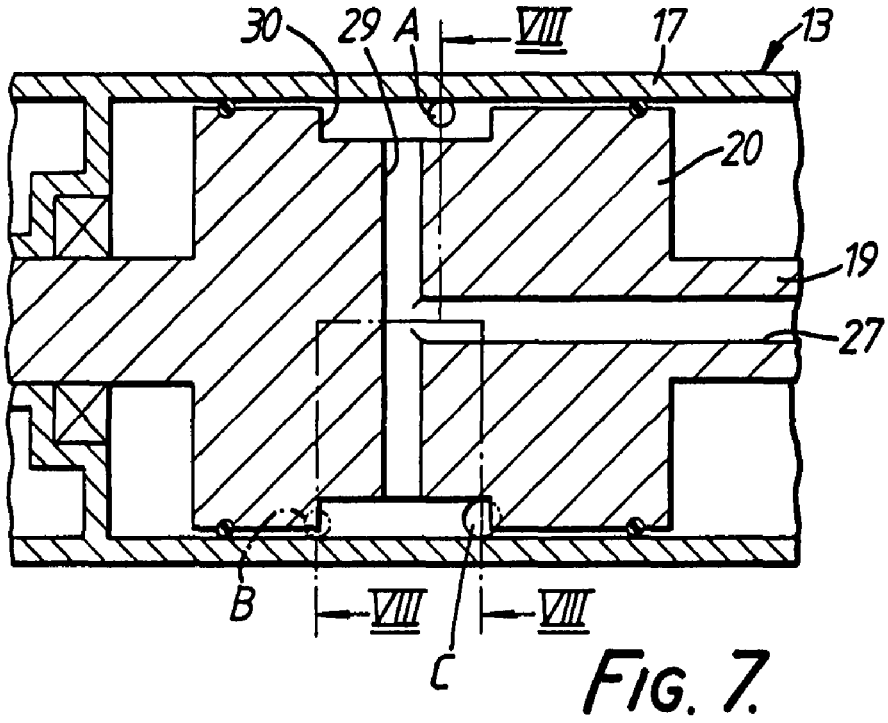
FIG. 7 is a schematic cross-sectional side elevation corresponding to that shown in FIG. 3, but illustrating a further disposition of the nose portion in which the discharge ducts are arranged to discharge propellant gas to produce a lateral steering force on the nose portion without roll torque.
Figure 8:
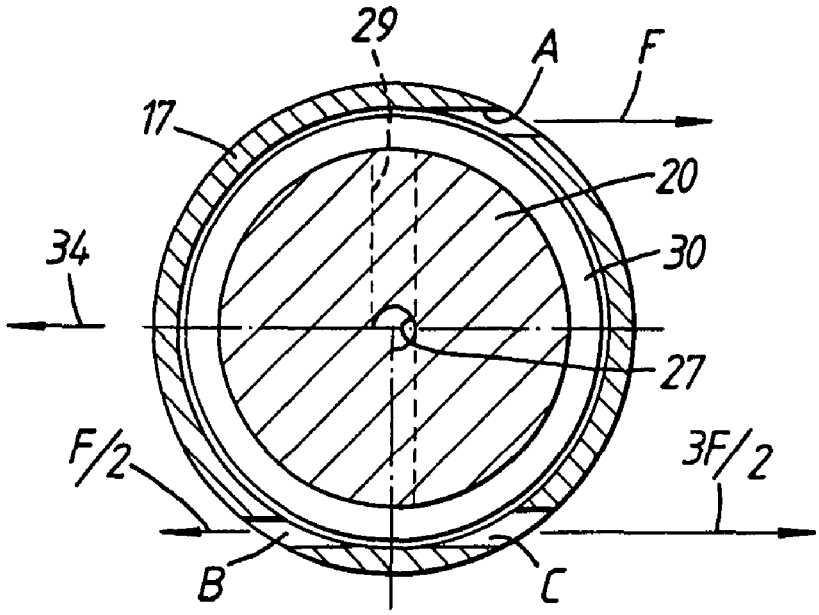
FIG. 8 is a schematic off-set cross-section corresponding to that shown in FIGS. 4 and 6 and taken on the line VIII-VIII in FIG. 7 to illustrate the thrusts produced by propellant gas discharged from the discharge ducts in the disposition of the nose portion shown in FIG. 7.

As a result of the braking roll torque, the nose portion 13 is brought to a demanded roll attitude and in response to signals demanding this roll attitude, the actuator 24 is caused to move the nose portion 13 to the disposition shown in FIGS. 7 and 8 where discharge duct A remains at full discharge capacity and produces an efflux force F. Discharge duct B is partially closed at half-full discharge capacity and produces an efflux force F/2 and discharge duct C is at three-quarters discharge capacity and produces an efflux force 3F/2. As best seen FIG.

8, the thrusts produced by propellant gas from the discharge ducts B and C partially cancel to produce a zero roll torque and a lateral thrust 34 substantially double the force generated at duct A.

It will be appreciated that, with the illustrated arrangement, steering of the missile depends upon appropriate energisation of the actuator 24. Given data on the discrepancy between the actual position of the missile, and its desired position (for example in the middle of a laser beam along which it is "riding"), and the instantaneous roll position of the nose portion 13, a microprocessor in the main body portion 12 can readily be employed to compute an appropriate control signal for the actuator 24. Those skilled in the art will be aware of means for providing data on positional discrepancy, and for establishing a roll position of the nose portion 13. For example, the missile could be a beam-rider type, in which photoelectric sensors on a rearward-looking surface of the missile gather information from a laser beam which is modulated so that the pattern or radiation within the beam is unique to any one position within the cross-section of the beam, and the roll position of the nose portion 13 can be determined by the use of a gyroscope in the nose portion.

The actuator 24 may take any one of a variety of different forms, but preferably comprises a linear servo motor coupled as shown in FIG. 2 to drive the nose portion 13 through a reciprocatory connecting rod 36.

The spinning nose portion 13 may include aerodynamic aileron and elevator control surfaces 35 and the roll and steering thrusts of the discharge ducts used to supplement them. The main body portion 12 includes rear fins 15 fixed at angles appropriate for inducing the main body portion 12 to spin or they could be used to provide it with lift, as required.

In an alternative embodiment of the invention, the distribution of discharge gas to the discharge ducts A, B and C may be controlled by reciprocation of the spool portion 20 instead of the nose portion 13.

Furthermore, a control sleeve may co-operate with the spool portion 20 in place of the skirt 17 of the nose portion 13 of the missile, but if the skirt is not to serve also as a control sleeve some advantage would need to be gained to compensate for the weight penalty of carrying both the skirt 17 and the sleeve.

The invention claimed is:

1. A missile comprising flight control means including a control portion rotatably mounted on a main body portion of the missile for rotation about the longitudinal axis of the missile and thrust producing means for controlling rotation of the control portion to bring, it to a demanded roll attitude and to apply a demanded lateral steering force on the control portion in the demanded roll attitude, the thrust producing means including a propellant carried by the missile for generating thrust producing propellant gas, a plurality of discharge ducts which have discharge openings in the surface of the control portion to provide for the discharge therefrom of propellant gas tangentially or partially tangentially with respect to the control portion and which are arranged to be supplied with propellant gas through supply ports arranged in predetermined spaced relation along the length of the control portion, valve means responsive to relative axial displacement of the control portion and the valve means selectively to control the flow of propellant gas to the supply ports and actuator means responsive to guidance control signals to cause relative axial displacement of the control portion and the valve means between a first relative disposition in which propellant gas is supplied to the discharge ducts and discharged from the discharge openings in such distribution and amount that it applies to the control portion a predetermined roll torque to bring the control portion to or assist it in being brought to a demanded roll attitude and a second relative disposition in which the propellant gas is supplied to the discharge ducts and discharged from the discharge openings in such distribution and amount that it applies to the control portion in the demanded roll attitude a predetermined lateral steering force on the missile.

2. A missile according to claim 1 wherein the control portion is mounted for axial displacement relative to the main body portion, and wherein the actuator means is operative to cause axial displacement of the control portion to bring the valve means and the control portion to their first and second dispositions.

3. A missile according to claim 2 wherein the valve means comprises a valve spool including supply ducts for the supply of propellant gas to the supply ports.

4. A missile according to claim 3, wherein the valve spool extends-forwardly from the main body portion in fixed relation thereto, wherein the control portion is a nose portion of the missile and is mounted on the valve spool with a skirt portion extending over the valve spool and wherein the discharge ducts are formed in the skirt portion.

5. A missile according to claim 4 wherein the discharge ducts comprise first and second ducts arranged on opposite sides of the control portion for the discharge of propellant gas tangentially in opposite directions and a third discharge duct arranged on the same side of the control portion as the second discharge duct for discharge of propellant gas tangentially in the same direction as the first discharge duct, wherein propellant gas is supplied to the first and second discharge ducts and discharged from the discharge openings in the first relative disposition of the control portion and the valve means to produce the predetermined roll torque and wherein propellant gas is supplied to at least the first and third discharge ducts in the second relative disposition of the control portion and the valve means to produce the predetermined lateral steering force on the missile.

6. A missile according to claim 5 wherein the first and second ducts are of equal predetermined discharge capacities, wherein the third discharge duct is of a discharge capacity twice that of the predetermined discharge capacity and the arrangement is such that when the control portion and the valve means move to the first relative disposition propellant gas is discharged at full discharge capacity from the first and second discharge ducts to produce the predetermined roll torque, with no propellant gas being discharged from the third discharge duct and when the control portion and the valve means move to the second relative disposition propellant gas is discharged at half the predetermined discharge capacity from the second discharge duct, at full discharge capacity from the first discharge duct and at three quarters discharge capacity from the third discharge duct thereby to produce a transverse thrust on the control portion without roll torque.

7. A missile according to claim 6, wherein the actuator means is responsive to the guidance control signals to cause relative axial displacement of the control portion and the valve means to a third relative disposition and the arrangement is such that in the third relative disposition no propellant gas is discharged from the second discharge duct, propellant gas is discharged at full capacity from the first discharge duct and from the third discharge duct in an amount equal to twice that of the first discharge duct thereby to produce a braking roll torque on the control portion opposite to the roll torque produced by the first and second discharge ducts in the first relative disposition of the control portion and the valve means, together with a lateral steering force on the missile.

* * * * *